US008317357B2

(12) United States Patent
Bayat et al.

(10) Patent No.: US 8,317,357 B2
(45) Date of Patent: Nov. 27, 2012

(54) SEALED SWITCH ACTUATOR FOR APPLIANCES

(75) Inventors: Bijan Bayat, Plano, TX (US); Mark W. Kempter, Plano, TX (US); James L. Newton, Arlington, TX (US)

(73) Assignee: Bayco Products, Inc., Wylie, TX (US)

( * ) Notice: Subject to any disclaimer, the term of this patent is extended or adjusted under 35 U.S.C. 154(b) by 464 days.

(21) Appl. No.: 12/683,781

(22) Filed: Jan. 7, 2010

(65) Prior Publication Data

US 2010/0254124 A1 Oct. 7, 2010

Related U.S. Application Data

(60) Provisional application No. 61/166,500, filed on Apr. 3, 2009.

(51) Int. Cl.
*F21L 4/04* (2006.01)

(52) U.S. Cl. ..... 362/206; 362/208; 362/205

(58) Field of Classification Search ..... 362/205, 362/206, 208, 202, 204, 109, 119, 120, 645, 362/394

See application file for complete search history.

(56) References Cited

U.S. PATENT DOCUMENTS

| | | | | |
|---|---|---|---|---|
| 5,752,764 | A * | 5/1998 | Shiau | 362/206 |
| 6,222,138 | B1 * | 4/2001 | Matthews et al. | 200/4 |
| 6,296,371 | B1 * | 10/2001 | Shiau | 362/206 |
| 6,513,947 | B1 * | 2/2003 | Huang | 362/206 |
| 6,612,715 | B1 * | 9/2003 | Shiau | 362/204 |
| D536,812 | S | 2/2007 | Bayat | |
| 7,222,995 | B1 | 5/2007 | Bayat | |
| 7,281,820 | B2 | 10/2007 | Bayat | |
| 7,402,961 | B2 | 7/2008 | Bayat | |
| 7,527,388 | B2 * | 5/2009 | Kim | 362/205 |

* cited by examiner

*Primary Examiner* — Bao Q Truong
(74) *Attorney, Agent, or Firm* — Whitaker Chalk Swindle & Schwartz PLLC; Stephen S. Mosher

(57) ABSTRACT

An electronic lighting instrument features separate optical assemblies for flood lighting and spot lighting. The optical assemblies include primary, secondary, and tertiary optical elements. The housing of the instrument features a trilobal cross section and includes dust-and-moisture-sealed push buttons and lenses as part of the housing construction. Self-aligning assemblies to ensure correct electrical and mechanical assembly are provided. The housing also self-aligns with a mating docking station for recharging the instrument batteries in situ. The lighting instrument may be controlled by a microprocessor circuit to provide floodlight and spotlight beams and several operational states thereof depending on the need for illumination or signaling.

13 Claims, 8 Drawing Sheets

SEALED SWITCH ACTUATOR FOR APPLIANCES

CROSS REFERENCE TO RELATED APPLICATIONS

The present application claims priority from an earlier filed provisional patent application, Ser. No. 61/166,500, entitled "Flashlight With Multiple Modes," filed Apr. 3, 2009, by the same inventors. This application is also related to U.S. Patent Application entitled "Optical Apparatus for Hand Held Lamps" and U.S. Patent Application entitled "Self-Aligning Construction for Flashlight Products," by the same inventors, filed here concurrently.

BACKGROUND OF THE INVENTION

1. Field of the Invention

The present invention generally relates to handheld lighting instruments and more particularly to optical apparatus for electronic lighting instruments having multiple modes of operation, including flood light and spotlight beams in an ergonomic structure for meeting industrial requirements.

2. Description of the Prior Art

Hand held lighting instruments have benefitted greatly from the development and availability of light emitting diodes, other compact light sources, small, more powerful batteries, and low cost programmable circuit devices. In prior art lighting instruments disclosed in U.S. Pat. Nos. 7,492,063; 7,402,961; 7,281,280; 7,222,995; and D536,812, all issued to the same assignee as the present U.S. Patent Application, electronic lighting instruments are described utilizing multiple light emitters and microprocessor control with commands issued by SPST switches operative in three distinct states to provide several flood lighting and spot lighting modes of operation. As useful as these lighting devices have become, they are relatively large, consume substantial power, and are not well-adapted to certain industrial or mobile uses. There is thus a need for smaller, more efficient lighting instruments that are adapted to a wider variety of uses.

SUMMARY OF THE INVENTION

Accordingly, further developments have improved the structure and function of lighting instruments and adapted them to additional uses as will be disclosed herein. Among the improvements are smaller, more compact construction, optical structures that provide brighter and more uniform illumination, push button actuators and lenses that are sealed against moisture and dust, housing structures that automatically align critical components during assembly, a self-aligning docking station for recharging internal batteries without removing them from the instrument, and the like.

In another embodiment a sealed push button actuator assembly for installation in an opening in the wall of a housing of an appliance is provided comprising an actuator assembly including a grommet having disposed there within a push button plunger having a concentric spring there around and configured for sliding movement against tension in the spring within the grommet; and a resilient boot enclosing portions of the actuator assembly external to the housing, the boot having a circumferential, inward-extending lip clamped between the grommet and the periphery of the opening in the housing, to provide a dust and moisture resistant seal of the opening.

In another embodiment a sealed push button actuator assembly for use with an appliance is provided comprising a push button plunger having a cylindrical body, a disc-shaped head disposed at a first end thereof and having a coil spring disposed around the body and against an underside of the head of the plunger; a grommet having a hollow, cylindrical body having an enlarged rim at a first end of the body and a circular array of prongs at a second end thereof. The second end further includes inward-extending fingers for retaining the spring. The plunger and coil spring are assembled within the grommet and allowed to move within the hollow body of the grommet against spring tension; and a resilient, cup-shaped boot open surrounds the actuator assembly, and a circumferential, inward-extending rim of the boot is clamped between the enlarged rim of said grommet and a periphery of the opening in the housing wall.

In one embodiment an optical assembly for a hand held lighting instrument is provided comprising at least first and second light emitters spaced apart on a planar base and oriented such that light is emitted in a forward direction; a reflector having an outer rim for reflecting light rays; and a lens having an incident surface and an emitting surface, the lens supported over the outer rim of the reflector and having cantilevered portions extending beyond each opposite end of the outer rim of the reflector, said cantilevered portions containing one or more V-grooves disposed in the incident surface across the width of the lens.

In another embodiment an optical assembly is provided comprising a primary optical structure including at least one light emitting device disposed on a base; a secondary optical structure extending from the base and including a concave reflecting surface surrounding the primary optical structure; a tertiary optical structure including a lens supported over a rim of the secondary optical structure, wherein the primary, secondary and tertiary optical structures are centered on a common axis defining a forward axis of illumination; and wherein the tertiary optical structure includes an array of parallel V-grooves disposed on the light incident side of the lens and oriented across at least one edge of the lens.

In another embodiment an end cap for a flashlight is provided comprising a detachable cylindrical cap open at a first end thereof and having an opening centered in a closed second end of the cap. An internal screw thread is disposed within the cylindrical cap on an inner wall thereof and extends helically toward the open end to an abrupt, butt end disposed at a predetermined location at a predetermined diameter of the cap near the open first end, such that the abrupt, butt end of the thread stops against a corresponding stop formed proximate a mating externally threaded portion of a housing of the flashlight when the cap is threaded onto the housing.

In another embodiment a handheld lighting instrument is provided comprising a tubular housing having a longitudinal axis, a first portion of the housing configured in cross section as a closed plane figure having three curved sides, the cross section of the first portion of the housing having a substantially constant width; a flood light beam emitted laterally from one or more light sources disposed in one of the three sides of the first portion of the housing; and a spot light beam emitted forward from one or more light sources disposed in a forward end of the first portion of the housing; wherein the tubular housing includes programmable circuitry for controlling said flood and spot light beams responsive to a sequence of switch actuations.

In another embodiment a self-aligning docking station for a rechargeable appliance is provided. The housing for the appliance is configured as an elongated tube having a round portion along a first length thereof and a substantially triangular portion along a remaining length thereof, the round portion merged with the substantially triangular portion at an intermediate portion of the housing. The docking station has a passage through it for receiving the intermediate portion of the appliance housing, the passage configured as a substantially triangular portion extending through a first portion of the passage that merges into a second, cylindrical portion through a remaining portion of the passage.

In another embodiment a housing for a handheld lighting instrument is provided comprising a one-piece tubular case for containing a lighting module having at least one light emitter, the case having at least one lens sealed within a first opening at a first location, at least one push-button actuator sealed within a second opening at a second location; and at least first and second mounts disposed within the case on opposite interior sides thereof for supporting the lighting module therein in correct operative alignment with the lens and actuator such that the lens is spaced apart from mechanical contact with the lighting module, and the actuator is spaced apart from mechanical contact with the lighting module except when the actuator is pressed to activate the light emitter.

In another embodiment a self-aligning module and housing assembly for a lighting instrument is provided comprising a tubular housing having first and second locating rails of a first type disposed on first and second opposite interior side walls within the tubular housing; a light emitting module with power contacts on a first end, the module supported within the housing on first and second locating rails of a second type disposed on opposite first and second sides of the module in respective positions to engage the first and second locating rails of the first type within the housing; at least one input control component mounted in a first opening in a wall of the housing in operative alignment with a corresponding control device disposed within the module; and at least one output conducting component mounted in a second opening in a wall of the housing in operative alignment with a corresponding light emitting source disposed within the module.

BRIEF DESCRIPTION OF THE DRAWINGS

FIGS. 1 through 10 illustrate various features of the construction of the present invention.

FIG. 1 illustrates an external perspective view of one embodiment of the present invention;

FIG. 2 illustrates a cross section view of a portion of the embodiment of FIG. 1 taken along a longitudinal centerline;

FIG. 3 illustrates a cross section view of a portion of the embodiment of FIG. 2 taken along a lateral centerline at right angles to the longitudinal centerline;

FIG. 4 illustrates a perspective view of an inner side of one embodiment of a reflector shown in the embodiment of FIG. 2;

FIG. 5 illustrates a perspective view of an underside of one embodiment of a lens used in the embodiment of FIG. 1 and shown in FIGS. 2 and 3;

FIG. 7 illustrates a lateral cross section view of a switch actuator assembly used in the embodiment of FIG. 2 taken along a lateral centerline at right angles to the longitudinal centerline;

FIG. 8 illustrates a perspective view of a grommet as used in the embodiment of a switch actuator assembly shown in FIGS. 2, 7, 9, and 10;

FIG. 9 illustrates an intermediate position of a portion of the switch actuator assembly of FIG. 7 as it is inserted into an opening in a housing;

FIG. 10 illustrates a lateral cross section view of a switch actuator assembly as installed in an end cap assembly of the present invention;

DETAILED DESCRIPTION OF THE INVENTION

Figure 1:
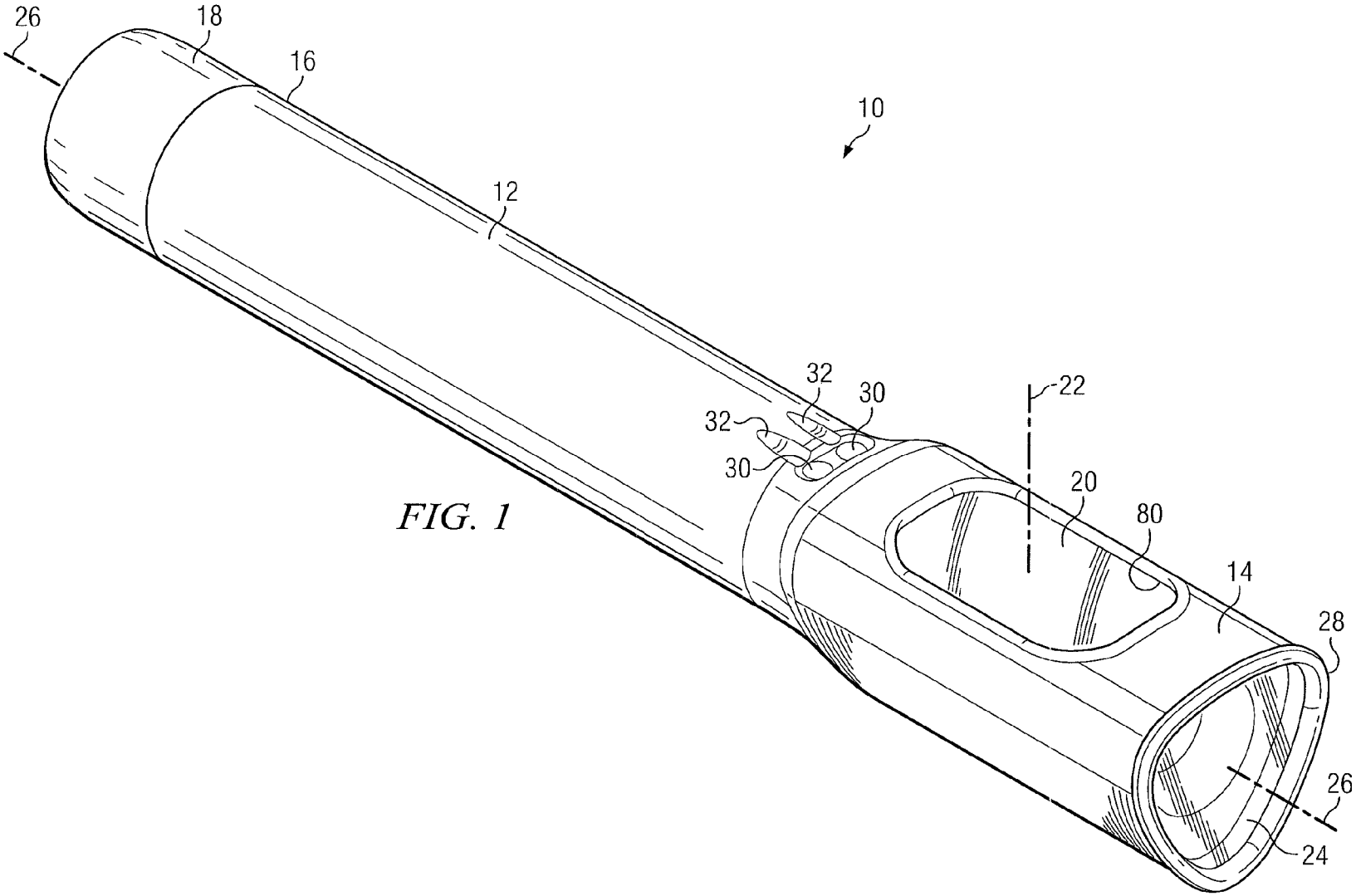

The inventions disclosed herein embody solutions to several problems with existing lighting instruments such as, for example, hand held flashlights. These solutions provide such useful advantages as reduced power consumption; smaller size and lower weight; more uniform beams of light; better use of flood and spot light beams; the capability of being used in hazardous environments; and the like. Accordingly, a number of new features and improvements to lighting instruments have been developed that advance the state of the art.

In lighting instruments designed for use in hazardous environments it is important to provide a housing or case that is sealed against dust and moisture, among other properties. Thus, any structure or component that must pass through the wall of the housing or case must be fully sealed. In conventional apparatus it is known to provide some mechanism to seal the component with respect to the housing. However, this can be a problem when the operative alignment of the component must be maintained. One solution is to provide for a sealing structure, possibly requiring adjustment of the component; however, this typically requires a more complex structure, adds a step to the production process, etc. In addition, when the housing or case is a one piece container fully surrounding the internal structure it may be difficult to both maintain correct operative alignment of the components with the opening(s) in the housing wall and maintain the integrity of the sealing structures as the unit is assembled.

These problems are solved in the present invention by spatially isolating those components that must pass through the wall of the unitary tubular housing or case from the internal structure within the housing or case. The internal structure, in the present illustrative example a lighting module that is complete and self-contained except for the structures involved in input control and light energy output, and the interior of the housing may be equipped with mating rail and track structures such as a mortise and tenon relationship that support the lighting module as well as position it in accurate alignment with respect to the locations in the housing wall wherein the input and output components are installed. Thus, these input and output components do not have to be physically or mechanically connected; they just have to be in the correct location. In the embodiment described herein, a push-button switch for controlling the input is aligned with a sealed switch actuator installed in an opening in the housing wall just above (i.e., on the same operative axis) but not in contact with the push-button of the switch. As long as the actuator is aligned with the switch button, because of the support structures on the inside of the housing and the lighting module and the accuracy to which they are manufactured, no special step in final assembly is needed to ensure proper operation—it is automatic by virtue of the mechanical design of the respective units. A similar result is obtained by positioning a lens in a sealed opening in the wall of the housing or case to permit the light produced by the lighting module to pass through the lens at the correct angle and without impairment because of a mis-aligned lens. These features will be described in detail herein below.

FIG. 1 illustrates an external perspective view of one embodiment of the present invention, a hand held lighting instrument 10. Instrument 10, housed in a unitary body or housing 12 having a first or head end 14 and a second or tail end 16, including a removable end cap 18, provides both floodlight and spotlight beams. A floodlight beam is emitted through a floodlight lens 20 along a flood illumination axis 22. The spotlight beam is emitted through a spotlight lens 24 along a spotlight illumination axis 26, which may be coincident, in the illustrative example, with the longitudinal axis of the lighting instrument 10. Accordingly, the spotlight and longitudinal axes are identified by the same reference number 26 herein. In some embodiments the spotlight illumination axis and the longitudinal axis may not be coincident. For example, the two axes may be offset and parallel with one another, or the spotlight illumination axis may be both offset and disposed at an angle with the longitudinal axis. In such cases where the two axes are not coincident, the longitudinal axis will be referred to by reference number 26 and the spotlight illumination axis referred to by reference number 26A. The floodlight illumination axis 22 is oriented generally normal to the longitudinal axis 26 in this illustrative embodiment. In other embodiments of the present invention, the orientation of the flood light illumination axis may be revised or adjusted to an angle different from a normal reference to the longitudinal axis 26 to adapt to a particular application.

Continuing with FIG. 1, the cross section shape of the body of the instrument 10 at the head end 14 is triangular as represented by the shape of the bezel 28. This shape, which will also be referred to as a trilobal design, is derived from the Reuleaux triangle, a closed, three-sided plane figure having curved sides and a constant width. Upon description in further detail herein below, the advantages of this configuration will become evident. The cross section shape of the body of the instrument 10 at the tail end 16 may be round. In this illustrated embodiment, the tail end 16 houses a battery power supply and associated circuit elements, and may provide an external surface texture to facilitate a non-slip grip. Approximately at the juncture of the head end 14 and the tail end 16 are placed a pair of battery charging contacts 30, which are recessed slightly in respective tapered grooves 32. The purpose of the tapered grooves 32 will become apparent in the description of the battery charging apparatus to be described herein below. Actuators, for actuating internal push-button switches in this example to effect control of the illumination features of the instrument 10, are not visible in FIG. 1, but may be located on the underside of the body 12 or in the end cap 18, as will be described. The unitary body or housing 12 and the end cap 18 may be molded of a suitable thermoplastic material such as Lexan® 121 or Xenoy® 2735, both available from SABIC Innovative Plastics, the present owners of the registered trademarks identified heretofore.

Figure 2:
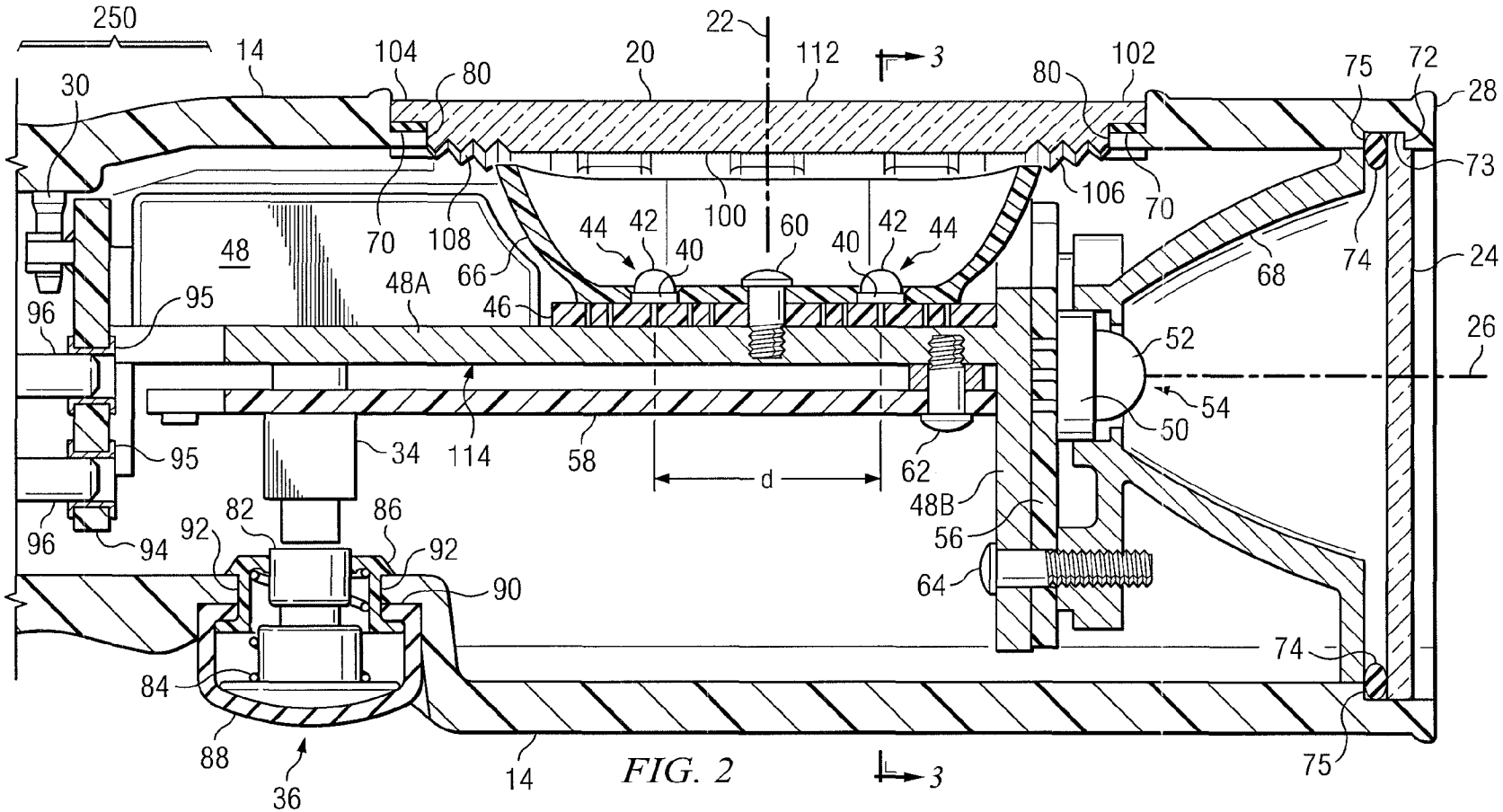
Figure 3:
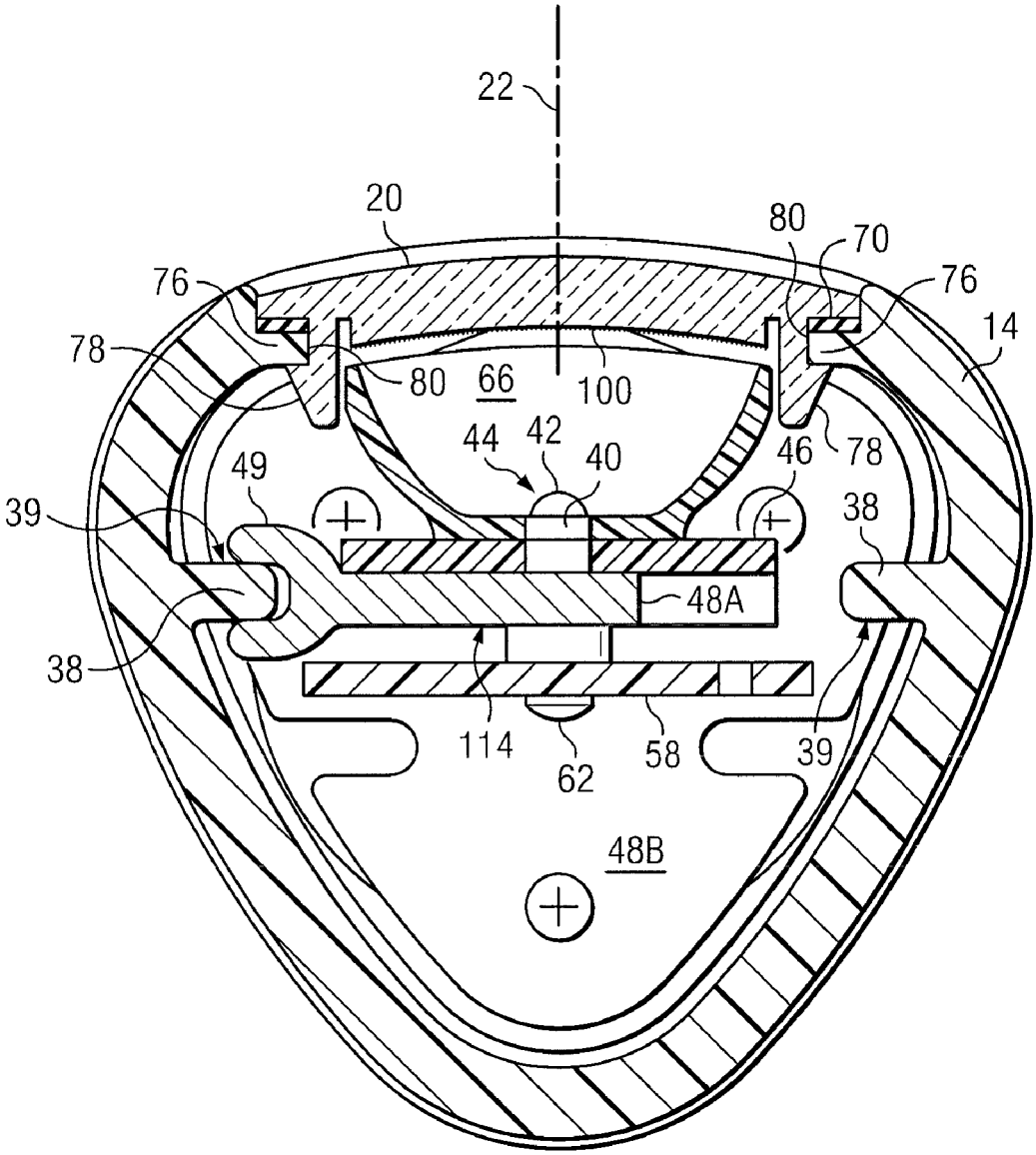

FIGS. 2 and 3 illustrate several views of an optical assembly or system for flood light illumination according to an embodiment of the present invention. The flood light assembly, as shown in a side view cross section in FIG. 2, is disposed to emit a broad, uniform beam of illumination generally along an axis 22 that is perpendicular to the longitudinal axis 26 of the housing 12 of the lighting instrument 10. FIG. 2 also includes details of a spot lighting optical assembly, aligned in this example with the longitudinal axis 26 of the housing 12. FIGS. 4 through 6B illustrate details of a reflector 66 and lens 20 of the flood illumination optical assembly.

In FIGS. 2 and 3, a side view cross section and an end view cross section respectively are illustrated. In this embodiment of the flood lighting assembly, two light emitting devices (LEDs) 42 are shown spaced a predetermined distance d apart and disposed along a longitudinal axis on a planar surface 46 (such as a printed circuit board) within the optical system. The separation distance d will be determined by the application and the geometry of the flood light beam it is desired to produce. An axis of illumination 22 (also referred to herein as the forward axis, or illumination axis of the flood light beam) is defined substantially perpendicular to both the slightly curved surface of the housing 12 and the longitudinal axis thereof. In present technology, a light emitting device ("LED") may typically be realized as a semiconductor light emitting diode. However, as will be appreciated by persons skilled in the art, the optical system described herein is well adapted to utilize any small, high intensity light source such as a small halogen bulb and the like that approximates a point source of light and satisfies other considerations such as relatively low heat dissipation, low power requirements, and small physical dimensions. As light emitting technology develops, other types of devices having these characteristics may be suitable for use in devices constructed according to the principles of the present invention.

The optical systems illustrated in FIGS. 2 and 3 includes the LED light sources 44, 54 and three optical components, including a primary optic, a secondary optic, and a tertiary optic for each of the flood light and spot light assemblies. The flood light assembly uses a pair of LEDs 40 in this example; the spot light assembly uses a single LED 50. As will become apparent, the secondary and tertiary optics shown in detail in FIGS. 4 through 6B are adapted to form a uniform flood light beam produced by the light sources 42. These figures depict features of the respective optics that can be readily adapted to various lighting configurations. The use of two light sources separated by the distance d in this illustrative example provides the needed light output to provide useful intensity in a beam having a broad angle of emission or beam width. In general, the principles embodied in the present invention may be adapted to other numbers of light sources used together. The present embodiment illustrates certain methods of handling the light artifacts that accompany the use of two or more light sources in combination with the primary, secondary, and tertiary optical features employed to shape the beam of illumination.

Continuing with FIG. 2, the primary optic component is a generally hemispherical ("dome") lens structure 42 or 52 covering—that is, placed in the light output path along the forward optical axis of the light source—each LED emitter 40 or 50 respectively. Each flood light source 44 and each spot light source 54 is respectively formed by the combinations of an LED emitter and a lens structure, respectively 40, 42 and 50, 52. The primary optics thus both protect its associated LED element 40, 50 and directs the emitted light in a substantially uniform beam along the forward optical axis of the LED emitter. Depending on the particular LED chosen, the beam may have an angle of emission (sometimes referred to as the half power beam width) typically in the range of 90° to 150°. The dome lens 42, 52 may be a clear silicone or other suitable material and is generally supplied as part of the LED emitter 40, 50.

The secondary optic in this example is a reflector element 66 (flood light), or 68 (spot light), which surrounds the respective light emitters 40, 50 and reflects light rays that are emitted by the light sources "off axis," i.e., at substantial angles relative to the forward axis of each LED emitter 40, 50. The purpose of the reflector in each case is thus to redirect the off axis light of its respective emitter in the forward direction. The reflector surfaces are generally symmetrical with respect to the forward axes 22, 26 and the light sources 44, 54. The "bottom" inside surface of the flood light reflector 66 is approximately coincident with the LED emitters 40, which are mounted on a planar base 46. The reflecting portions of the inside surface of the flood light reflector 66 may be curved according to a suitable conic section such as a parabola, or generally configured with a curved, concave profile to form the flood light beam of emitted light to suit particular applications.

The reflector 66 may include a rim that defines a boundary of the reflector and may in some alternate embodiments provide support for a lens element to be described. In this example however, the lens 20 may be supported separately from the reflector rim on a stepped ridge or ledge formed into an opening in a side of the housing 12. Another feature of the reflector 66 in this example is its surface finish. In the illustrated embodiment the finish is chosen to be a high gloss black finish. The black color of this high gloss finish, by absorbing some light rays that impinge upon its surface, tends to smooth out or filter some of the artifacts—variations in light intensity, often manifest as "striations"—that are present in a reflected beam. Such artifacts may occur in optical systems employing multiple light emitters in combination with some sort of reflector. The result is a more uniform beam of light that is relatively free of artifacts such as the so-called striations often seen with conventional handheld lighting devices or flashlights.

The tertiary optic in the flood light example shown in FIGS. 2 and 3 is a lens element 20 disposed across, and may be supported in an opening 80 in the housing 12, and in front of the light sources as shown in FIGS. 2 and 3. The lens 20, in addition to its mechanical function to act as a protective cover for the light sources 44 and the reflector 66, is transparent to light radiated into space along the forward axis 22. The lens 20 may further be configured to refract off-axis light rays emitted from the light sources. The lens 20 may be made of a transparent optical material, such as Lexan® 121, a polycarbonate material. Lexan® is a trademark formerly owned by General Electric and now registered in the name of SABIC Innovative Plastics. The light-incident surface in the present embodiment of the lens 20 may be slightly etched, such as by a wire EDM (electric discharge machining) process, to provide a thin, very fine-grain matte finish for filtering or diffusion of reflected beam artifacts. The matte finish thus acts in cooperation with the black finish of the reflector 66 to minimize the aforementioned artifacts. The finishes applied to the reflector 66 will be described further herein below in conjunction with FIG. 4.

Returning to FIG. 2 there is further illustrated the structural features of a spot lighting assembly or system comprising a single LED light source or emitter 50 with a primary optic, dome lens 52, a round reflector (secondary optic) 68, typically having a conic section profile along the forward direction of light emission for defining a spot light beam, and a transparent lens (tertiary optic) 24 having a flat plate configuration in the present illustrative embodiment. The functions of the three types of optics are similar to the three types employed in the flood light optical system except that the spot light reflector 68 (secondary optic) is configured to conform the light beam into a much smaller angle, and the lens 24 for the spot light optical system is simpler. Since the reflector 68 redirects light emitted off the optical axis 26 of the emitter into a beam composed of substantially parallel rays, there is little need for anything other than a flat plate lens to produce a uniform spot light beam essentially free of artifacts. Such artifacts may be minimized by conforming the reflector curvature to an accurate conic section and careful alignment of the light beam output along the optical axis of the source and lens combination. The principal qualities of the lens 24 are that it be flat, rigid, and optically clear. The outer rim of the reflector may be formed as a bulkhead that extends radially outward to intersect the interior of the trilobal housing, thereby to center the spotlight optical system within the non-circular housing and align the spotlight beam with the longitudinal axis of the handheld lighting instrument. In some embodiments, as illustrated in FIG. 2, the rim of the reflector 68 may be molded with the bulkhead as an integral component, enabling the reflector 68 to provide mechanical support for the spotlight optics in addition to its optical function. The lens 24 may preferably be retained by several narrow tabs 72 extending outward from the perimeter of the body of the lens 24. For example, as illustrated in an upper portion of FIG. 2, a tab 72 is shown extending into a groove 73 formed into the inside wall of the housing 12. The lens 24 is preferably sealed against dust and moisture with an O-ring gasket 74 positioned between the edge of the lens 24 and a shoulder 75 located at the position of the tab 72. In other embodiments, a resilient gasket of other cross section may be used instead of O-ring 74. The lens 24 may also serve to longitudinally define the position, of the module within the housing 12 as will be further described with FIGS. 2 and 3.

Further shown in FIG. 2 are a frame 48 and printed circuit boards 46, 56, 58, and 90, which together form a mechanical subassembly for the optical components described herein above. The frame 48 in the illustrative example is formed of a main frame 48A and a sub-frame 48B. The sub-frame 48B is disposed at a right angle with the main frame 48A in this illustrative example. The frame 48 may preferably be cast or machined as a unit of a metal material or compound such as aluminum that has good thermal conductivity. Alternately, the frame 48A and sub-frame 48B may be separately assembled with screws or other attachment. As shown, the combined main and sub-frame 48A, 48B functions as a heat sink and supports the various printed circuit boards (PCBs 46, 56, 58, 90). The PC boards 46, 56, 58, 90 support or contain the electrical circuitry in the instrument 10 and may be interconnected via wiring and other types of connection devices. The interconnecting wiring and certain connecting devices are not shown herein for clarity, as they are components well known to persons of skill in the art and do not form an essential part of the novel features of the inventions disclosed herein. In the present example, PCB 46 couples the control circuits located on PCB 58 for the flood light and spot light sources 44 and 54 respectively. PCB 46 is secured to the heat sink/frame 48A with one screw 60. PCB 56 contains the drive circuits for the spotlight source 54 and is secured to the heat sink/frame 48B via a screw 64. PCB 58 is secured to the heat sink/frame via screw 62. PCB 58 in this illustrative example also supports a push button (control) switch 34 for controlling ON, OFF, and operating modes of the lighting instrument 10. Operation of the switch 34 will be described in detail in conjunction with FIG. 7.

The housing 12 may typically include in this illustrative embodiment a battery power supply comprising one or more batteries (not shown) housed within the cylindrical tail end 16. The battery power supply may advantageously be implemented as a battery pack. Tail end 16 may also function as a handle. Current from the power supply may be applied through conductors (not shown) internal to the housing 12 from the terminals of the battery power supply to contacts for engaging with a PCB 94. PCB 94 may contain power connection circuits that interconnect the battery power supply conductors with the control circuit PCB 58. PCB 94, which may be secured to the heat sink/frame 48 by a screw (not shown for clarity), and further include contact receptacles 95 for receiving battery pack contacts 96. Receptacles 97 on PCB 94 are provided to connect battery charging contacts 30 to the battery power supply conductors during charging of the battery power supply in the instrument 10.

As illustrated in FIG. 2, the entire combination of lighting assemblies 44, 54, heat sink/frame 48A, 48B, and PCBs (46, 56, 58, 90), which are secured to each other, form an integral lighting unit 114 (or, lighting module 114) that may be installed or removed as a unitary structure within or from the first end 14 of the housing 12. This integral lighting unit 114 may be supported on ledge-like locating tracks 38 formed into opposite interior side walls of the housing 12. The U-shaped locating rails 49 formed along both sides of the heat sink/main frame 48A, as shown in FIG. 3 to be described, engage the locating tracks 38 as the lighting unit 114 is inserted into the housing 12.

Referring to FIG. 3, a view looking forward in the direction of the spot light beam along the longitudinal axis 26, depicts the cross section of the lighting instrument 10 at the location of the LED 42 nearest the sub-frame 48B (See FIG. 2). Note that in the particular cross section shown in FIG. 3, the rail 49 appears on one side only. If the cross section view were moved rearward slightly (See FIG. 2), the rail 49 would appear on both interior sides of the lighting module 114. Note also that the terms 'locating rails' or 'locating tracks' may apply to either the rails or tracks 49 or to the tracks or rails 38 as will become apparent from the following description. Further, The U-shaped locating rail 49 may be referred to as having a mortise shape in cross section, while the ledge-like locating rail may be referred to as having a tenon cross section, such that upon assembly the rails 49 and 38 fit together in the manner of a mortise and tenon when viewed in cross section. Thus assembled, the lighting unit 114 is locked into position with respect to movement in the vertical and lateral directions with reference to FIG. 3. The vertical direction is parallel to the broken line 22 in the figure; the lateral direction is at right angles to the broken line 22. To lock the lighting unit 114 in the for-and-aft directions, that is, along the longitudinal axis 26 (See FIG. 2) the sub-frame 48B of the lighting unit 114 acts as a stop against the forward ends 39 of the tenon rails 38 inside the housing 12 to limit further rearward movement of the lighting unit 114. The position of the forward ends 39 of the tenon rails 38 is shown in FIG. 3 against the sub-frame 48B. Similarly, as the lens 24 is snapped into position within the groove 73 against the resilient gasket or O-ring 74 and the adjacent edge of the reflector 68 (See FIG. 2), the lighting unit 114 is secured against forward movement.

Assembly of the lighting module 114 into the housing 12 is simple: merely position the longitudinal axis of the lighting module 114 along the longitudinal axis of the housing 12 (which is substantially coincident with the illumination axis 26 of the spot light LED 50) with the spot light reflector 68 disposed away from the end of the housing 12, and align the locating rails 49 of the lighting module 114 with the locating tracks 38 on the interior side walls of the housing 12 as the lighting module 114 is eased into the housing 12. The rails 49 and tracks 38 may preferably be related as mortise and tenon respectively. In alternate embodiments, the this configuration may be reversed, with the rails 49 and tracks 38 may preferably be related as tenon and mortise respectively. The lighting unit 114 will slide into position until the sub-frame 48B contacts the forward ends 39 of the tracks 49 as described herein above. Further, the lighting unit 114 will slide into position with the receptacles 95 and 97 coming into full engagement with their respective terminals of the battery pack and charging contacts inside the housing 12 at substantially the same time and position as the back side of the rim of the reflector 68 and a gasket 74 disposed there between comes to rest against a shoulder 116 disposed in the spot light end of the housing 12. Persons skilled in the art will recognize the orientation and construction of the receptacles provides electrical and mechanical contact with sufficient tolerance to accommodate slight variations in the mechanical dimensions of the lighting module 114. The lighting module 114 is retained in place by installation of the spot light lens 24 and the gasket 74, which are retained together by tabs 72 disposed on the perimeter of the lens 24 that are positioned within grooves 73 formed in the inside surface of the housing 12.

Thus installed and located, operative alignment of all other structures is ensured, and no further mechanical or electrical connections need to be made to locate the lighting module 114 in the housing 12 or to connect the circuits of the lighting module 114 to other structures. This operative alignment includes the flood and spot light optical assemblies (primary and secondary optics and the drive circuits in the lighting module 114) with the respective lenses 20, 24 and the switch actuator(s) 36 with their respective push button switch(es) 34 mounted on the lighting module 114. Thus, this construction provides a self-aligning module 114 and housing 12 assembly wherein at least one input control component (such as a switch actuator 36) is mounted in the wall of the housing 12 in operative alignment with a corresponding control device (such as push-button switch 34) disposed within the module 114, and at least one output conducting component (such as the lens 20) is mounted in a wall of the housing 12 in operative alignment with a corresponding light emitting source (such as the pair of LED light sources 44) disposed within the module 114. Disassembly of the module 114 from the housing 12 is accomplished by reversing the procedure after removing the spot light lens 24 and gasket 74.

The foregoing description of the installation of the lighting module 114 into the housing 12 exploits the self-aligning structure that ensures correct alignment of electrical contacts that connect circuits together upon assembly and correct alignment of the tertiary optics with the primary and secondary optics. The mechanical structure thus eliminates misalignments and malfunctions, the need for fasteners in final assembly, and the need for adjustments. The components involved provide automatic alignment of battery contacts to the drive circuits, of control switches to the drive circuitry, and the battery charging contacts with the charging station as described above. Other alignment features include alignment of the drive circuitry in the lighting module and the lens systems for the flood and spot light systems to provide optimum illumination without further adjustment. One example of the latter is the support of the heat sink/frame 48 (including the main frame 48A and the sub-frame 48B) and the PCB circuits (46, 56, 58, 90) mounted thereon, which together form the lighting module 114 and are aligned and supported on the rails 38 on the inside walls of the housing 12 at the first end 14 thereof. Further, the snap-in construction of the lens 20 into the opening 80 of the housing 12 (See the description of the lens 20 in FIG. 5 herein below) likewise provides both support and correct alignment of the lens 20 with the corresponding components of the flood lighting assembly. The self-aligning construction also minimizes the need for assembly tools, enabling lower costs of production as well as accurate assembly. Moreover, the spatially separate switch actuators and lenses described herein may be securely sealed against dust and moisture, in effect made part of the housing 12 instead of the lighting module 114, a construction that presents fewer compromises in performance and reliability.

Continuing with FIG. 3, this view includes the primary 44, secondary 66 and tertiary 20 optic structures of the flood lighting assembly as previously described. As shown, the PCB 46 for the primary optic 44 is supported by the main frame 48A, itself supported by the locating rails 49 on the locating tracks 38 that are disposed along the interior side walls of the housing 12 within the first end 14 thereof. Although not shown in this view, looking forward from the forward most light source 44, the heat sink/main frame 48A is supported by the locating tracks 38 on both sides of the interior side wall of the housing 12. Further, the lens 20 (tertiary optic) is shown retained and supported in the housing 12 by prongs 78 that snap into place around the edges 76 formed into each side of the opening 80 in housing 12. See also FIG. 2 for an additional view.

FIG. 3 also illustrates a cross section of the three-sided or trilobal tubular housing 12 chosen for the embodiment described herein. The trilobal housing facilitates the disposition of the flood lighting system with its relatively flat but slightly convex lens 20 in a side-mounted configuration. The three-sided structure provides an inherent stability through an anti-roll mechanism that enables the instrument to be self-positioning when laid on its side. That is, when the instrument is laid on either of the two sides adjacent the flood light lens, the flood lighting beam is automatically aimed at an angle of approximately 30° to the horizontal. This turns out to be a convenient angle for illuminating the work area when changing a vehicle tire or other bench top or table top tasks, for example. Further, the rounded surface of the sides enables the instrument to be adjusted to angles slightly larger or smaller than the nominal 30° by propping the appropriate one corner of the trilobal housing or the other corner. Moreover, the three-sided shape, having slightly rounded (convex in this example) sides, a property of a closed figure having a constant width, enables the flood light lens 20 to have the same curvature as the body 12 of the housing at the first end 14 thereof, thereby facilitating formation of the flood light beam from the optics enclosed within the housing and providing a smooth, rounded aesthetic appearance. The three-sided housing also enables the alignment of the housing in a charging station to be self-keying when inserted therein such that battery charging contacts in the side of the housing are automatically oriented toward the contacts in the interior of the battery charger. The operation of this feature will be described further herein below.

Figure 4:
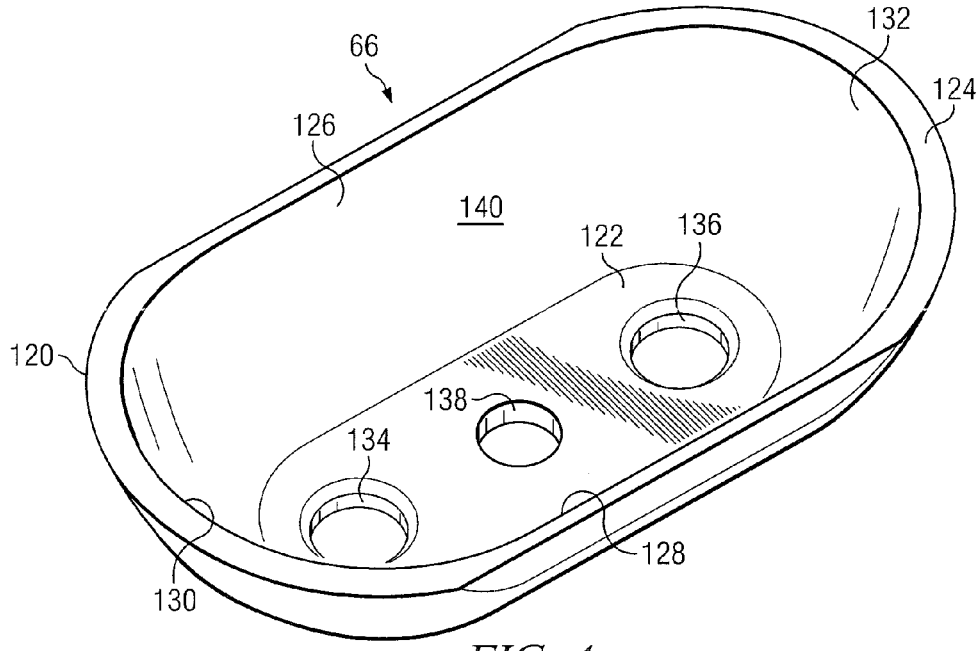

Referring to FIGS. 4 through 6B, further details of the secondary and tertiary optics for the flood lighting assembly, respectively the reflector 66 and the lens 20, will be described. In FIG. 4, a perspective view of the inner side of one embodiment of the reflector 66 shown in FIG. 2 is illustrated. The tub-like reflector 66 includes a side wall 120 and a planar base 122 joined to the side wall 120 at a lower portion thereof. The side wall 120 includes a rim 124, first and second interior side walls 126, 128 disposed opposite to each other, and first and second interior end walls 130, 132, also disposed opposite to each other. The planar base includes circular openings 134 and 136 corresponding to the positions of the first and second light sources 44, which are separated by the distance d (See FIG. 2), and a mounting hole 138 positioned in the center of the planar base 122. The mounting hole 138 is used to secure the reflector 66 and the PCB 46 to the main frame 48A using the screw 60 as shown in FIG. 2. The first and second interior side walls 126, 128 in this illustrative embodiment may be substantially straight along each side and may further be a portion of a conic section or other curve in profile, depending on the beam configuration desired. The first and second interior end walls 130, 132 are generally circular in this embodiment, with their respective radius of curvature centered on the optical axis of the corresponding light sources 44. In profile, the curvature of the end walls may be a portion of a conic section or other suitable curve, likewise depending on the beam configuration desired.

The interior surfaces 140 of the side and end walls 126, 128, 130, and 132, and of the planar base 122 are finished in a high gloss black color. The black color absorbs some of the light energy emitted by the light sources 44, thus having a mild filter effect that tends to even out the intensity variations of the stronger wavelengths. The high gloss finish provides high reflectivity for directing the light energy in the forward direction to provide the flood light illumination. The beams of the two spaced-apart light sources 44 are combined by the geometry and reflecting properties of the reflector 66 to provide a bright beam of uniform intensity, having a minimum of artifacts, and shaped to provide a flood light beam having a beam dispersion of maximum utility.

Figure 5:
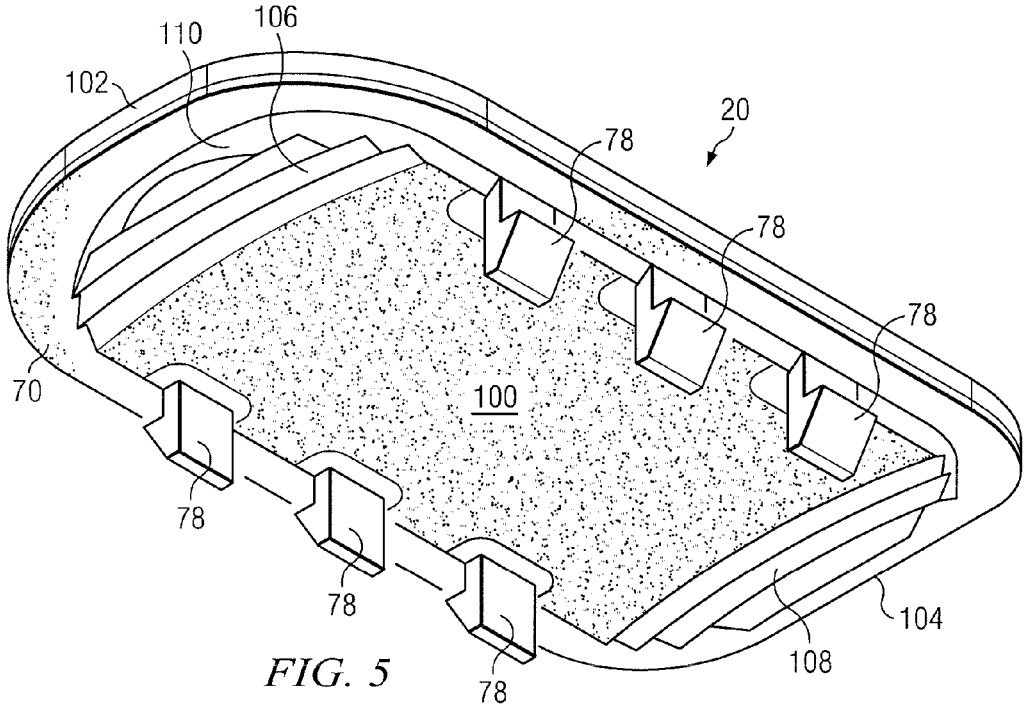

Referring to FIG. 5, there is illustrated a perspective view of an underside of one embodiment of the lens 20 used in the embodiment of FIG. 1 and shown in lengthwise and lateral cross section views in FIGS. 2 and 3. The same reference numbers that identify features shown in FIGS. 2 and 3 are used in FIG. 5, which shows the lens 20 in isolation from its related structures. The lens 20 in this embodiment has a generally rectangular outline with rounded corners of substantially equal radii, in the manner of a standard "oval" race track. The ends of the lens 20 are denoted by the reference numbers 102, 104. The V-groove features at each end of the lens 106, 108, are disposed on the underside or light-incident side 100 of the lens 20. The functional portion of the lens 20 is defined by a boundary 110 surrounding the portion of the lens that is actively involved in the formation of the flood light beam. The light incident side 100 is shown having a thin, very fine-grain matte finish as herein described with reference to FIG. 2. Further details of the structure of the V-groove features is provided with reference to FIGS. 6A and 6B herein below.

The lens 20, in addition to its mechanical function to act as a protective cover for the light sources 44 and the reflector 66, is transparent to light radiated into space along the forward axis 22 shown in FIG. 2. The lens 20 may further be configured to refract off-axis light rays emitted from the light sources 44. The lens 20 may be made of a transparent optical material, such as Lexan® 121, a polycarbonate material. Lexan® is a trademark formerly owned by General Electric and now registered in the name of SABIC Innovative Plastics. The light-incident surface in the present embodiment of the lens 20 may be slightly etched, such as by a wire EDM (electric discharge machining) process, to provide a thin, very fine-grain matte finish to provide some filtering or diffusion of reflected beam artifacts. The matte finish thus acts in cooperation with the black finish of the reflector 66 to minimize the aforementioned artifacts. The finishes applied to the reflector 66 were described herein above with reference to FIG. 4.

It will be appreciated by persons skilled in the art that the body of the flood light lens 20, while being relatively thin compared to the width of the lens, nevertheless acts as a channel for some of the light that is scattered by the matte finish 100 and refracted according to Snell's Law of Refraction from rays entering the lens body at a large angle relative to the normal to the incident surface. Most of this light—estimated at approximately 10% of the total output of the of the light sources 44—is diffused or lost to the surroundings, unless the lens is designed to capture and redirect this light. Fortunately, the geometry of the lens 20 in the present illustrative example permits this leakage light to pass within the thickness of the lens 20 into the first 102 and second 104 ends of the lens, which are disposed outside the rim of the reflector 66 in cantilevered fashion just beyond each end of the reflector 66.

Continuing with FIG. 5, the foregoing construction of the lens 20 applies whether the shape of the lens 20 is oval or oblong or rectangular. There, at the first and second ends 102, 104, the presence of a series of lateral V-grooves 106, 108, which function as prisms (aka prismatic ridges or cross prisms herein) and reflective surfaces formed into the underside of the first 102 and second 104 ends of the lens 20 beyond the boundary formed by the reflector rim 124. The V-grooves 106, 108 provide a way to gather the leakage light rays and redirect them in the forward direction along axis 22 where they supplement the main flood light beam emitted from the optical combination described herein. These V-grooves or prisms 106, 108 are a non-trivial and novel feature of the lens 20. Their geometry is specifically configured to refract and reflect the leakage rays into the forward beam. The effect is to strengthen the flood light beam slightly and to compensate for the small amount of absorption of light due to the filtering action of the reflector and the matte finish on the underside 100 of the lens 20. In the present embodiment, the lens 20 may be supported in the housing on a perimeter gasket 70 that is provided to seal the housing interior from moisture and dust.

In an alternate embodiment wherein a reflector and its corresponding lens may be circular (instead of oval or oblong), the prism-like ridges, which may be formed beyond the rim of the reflector may likewise be circular and arranged in several concentric rings surrounding the rim of the reflector.

The cross prism or V-groove feature described herein may also be used to obscure certain portions of the structure of the apparatus behind the lens. If the angles of the V-groove faces 106, 108 formed into the underside (light incident side) of the lens 20 are disposed at substantially 90° with respect to each other, and a line bisecting that angle and normal to the light emitting surface of the lens extends parallel with the direction of the forward emission of the light sources, i.e., normal to the lens 20, as along the forward axis of emission 22, then the faces of the V-grooves 106, 108 will appear to be mirror surfaces because of light refracted in the thickness of the lens material. The mirror surfaces appear opaque when viewed directly in front of the V-groove portion of the lens 20, thus obscuring structures behind them. When viewed off-angle such as approximately 30° or more with respect to the normal line, objects on the other side of the lens may be visible. In addition, some ambient light from outside the apparatus will be reflected 180°—i.e., back out from the lens in the forward direction.

Figure 6A:
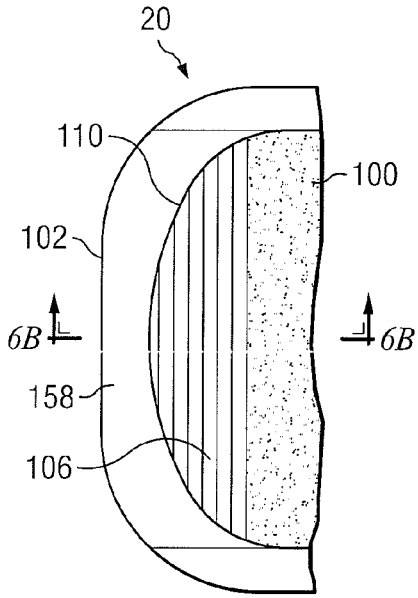
FIG. 6A illustrates a plan view of one end of the light incident side of the lens of FIGS. 2 and 5.
Figure 6B:
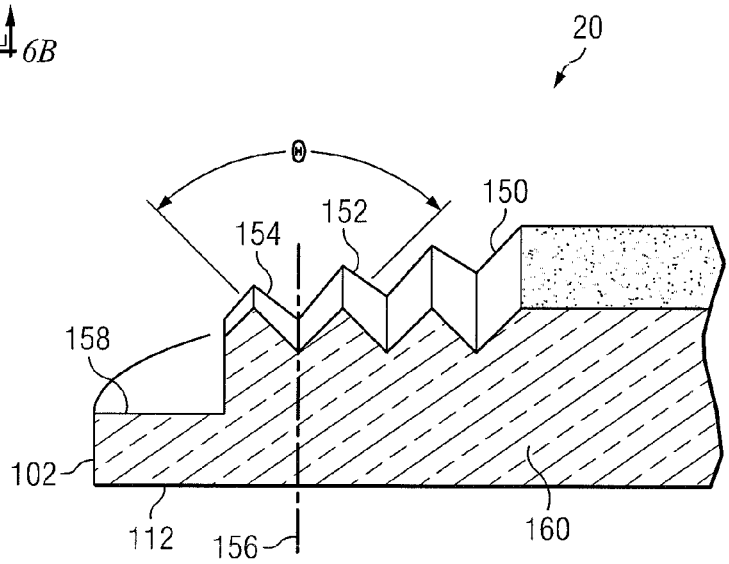
FIG. 6B illustrates a longitudinal cross section view of the end of the lens shown in FIG. 6A.

Referring to FIGS. 6A and 6B, several detail features of the lens 20 of FIG. 5 will be described. FIGS. 6A and 6B illustrate two views of a first end 102 of the lens 20. FIG. 6A depicts a plan view of the light incident surface, and FIG. 6B depicts an enlarged cross section of the lens to show the details of the V-groove features 106. In FIG. 6A, the plurality of V-grooves 106 are shown disposed across a first end 102 of the lens 20, terminating at the boundary 110 previously described. Also shown in FIG. 6A are the light-incident surface 100 and a gasket surface 158 for receiving a gasket 70 (See FIG. 2). The perspective is looking directly at the light-incident surface along a normal reference line thereto. This view is provided to define the perspective shown in FIG. 6B.

In FIG. 6B are shown three V-grooves 150, 152, 154 formed into the light-incident surface 100 such that a line 156 bisecting each V-groove angle is substantially normal to the light-emitting surface 112 of the lens 20. Each V-groove subtends a nominal angle of $\theta=90°$. Thus, each face of a V-groove, which may be polished, is disposed at a nominal angle of $\theta \div 2=45°$ to the reference line 156. Further, each V-groove is formed completely across the light-incident surface 100 of the lens 20 such that it terminates at the lens boundary 110.

In one embodiment of the lens 20, the V-grooves 106, 108 form a series of parallel, elongated right angle prisms disposed across each end 102, 104 of the oval-shaped lens 20. The prism faces are formed in the light-incident surface 100 of the lens 20 such that a normal line 156 to the light-emitting surface of the lens 20 (which is substantially parallel to the forward illumination axis 22) bisects the right angle $\theta$ between the faces of each prism V-groove 150, 152, 154. Thus each of the right angle faces of the prism is disposed at the aforementioned 45° angle with the light-incident surface 100 of the lens 20. The result of this configuration is that light scattered within the lens 20 is redirected, through reflection and refraction, toward the forward direction along axis 22 to supplement the forward emission of light from the light sources 44. Another result of this configuration, readily apparent from a position external to the handheld instrument 10, is that the right angle prism features 106, 108 at the respective ends 102, 104 of the lens 20 reflect ambient light via two successive 90° reflections (from two adjacent, facing surfaces of the right angle prism configuration), thereby producing the afore-mentioned mirror effect from each surface appearing as a very thin elongated mirror across the end of the oval flood lens 20.

As noted above, this property of the right angle prism configuration has other applications as a diffusing element or as a means to obscure the light sources while still being transparent to the emitted light. In such applications, by placing the right angle prism ridges or V-grooves 150, 152, 154 across the light-incident side 100 of the lens 20, that portion of the lens 20 having the prism ridges appears as a mirror when the light sources 44 within the instrument 10 are turned off. This effect is caused by the ambient light reflecting from the two adjacent, facing prism faces thus making a 180° turn toward the user. When the light sources 44 are turned on, the lens 20 is fully transparent to the light. Conversely, when the light sources are turned off, the reflection of the ambient light from the prism faces renders that portion of the lens 20 as an opaque element. That portion of the lens appears as a mirror, thus obscuring the structures behind it.

In an alternate embodiment, the prism ridges or V-grooves may be configured in arcs having centers along the longitudinal axis of the flood lens 20, enabling them to gather more of the light leakage and redirect it in the forward direction. Further, such prism ridges or V-grooves may be disposed as complete or partial circles in that portion of a round lens extending beyond the outer boundary of a round reflector. Such configuration would be provided to recover light rays otherwise lost to leakage or to provide enhancement to the forward beam. In yet another embodiment, the entire light incident side of the lens may contain the V-groove features to obscure the light sources when they are turned off.

Thus, the combination of the features of the primary, secondary, and tertiary optics of the flood light optical system shown in FIG. 2 acts to maximize the light output into the forward angle of the optical system and to minimize the presence of artifacts in the beam, thus providing a strong, uniformly bright flood light beam from a handheld lighting instrument 10. In the embodiment illustrated herein, the flood light optical system is disposed in one side of the first end 14 of the three sided housing 12 shown in FIG. 3 to be described.

FIGS. 7 through 10 illustrate a novel switch actuator 36 or push button actuator that may be installed in an opening in the side of the housing 12 or in an end cap 18. The switch actuator assembly 36 illustrated herein describes an assembly adapted to a round opening in the housing. Other shapes for the opening are possible and similar in configuration. The configuration to be described has several features that distinguish it from prior art push buttons known for flashlights. These features include (a) a resilient boot design that fully encloses the external portions of the actuator assembly and forms a gasket between the actuator assembly components and the housing to seal out dust and moisture; and (b) a separate plunger that when pressed directly contacts the switch button of an internal push button switch for positive, unambiguous operation of the switch within the housing. Having an actuator that is separate from the switch push button prolongs the life of the switch because of the uniform angle of actuation of the internal switch push button. It will also be appreciated that the mechanical or spatial separation of the switch actuator from the switch mechanism greatly facilitates assembly and disassembly of the product that uses this combination of separate actuator and switch assemblies because each assembly is supported on different structures. This configuration is an advantage when internal components of the lighting instrument 10 may be installed from one end of the one-piece housing 12, as a single assembly, without requiring separate installation or assembly of structures that interact or bridge between the internal components and the housing 12. This feature will be described further herein below. Persons skilled in the art will recognize that this combination of a separate, sealed switch actuator used with an internally mounted push-button switch mechanism is not limited to flashlights or other lighting instruments but may find application in a wide variety of products having the switch mounted behind the wall or panel of an enclosure or housing.

Figure 7:
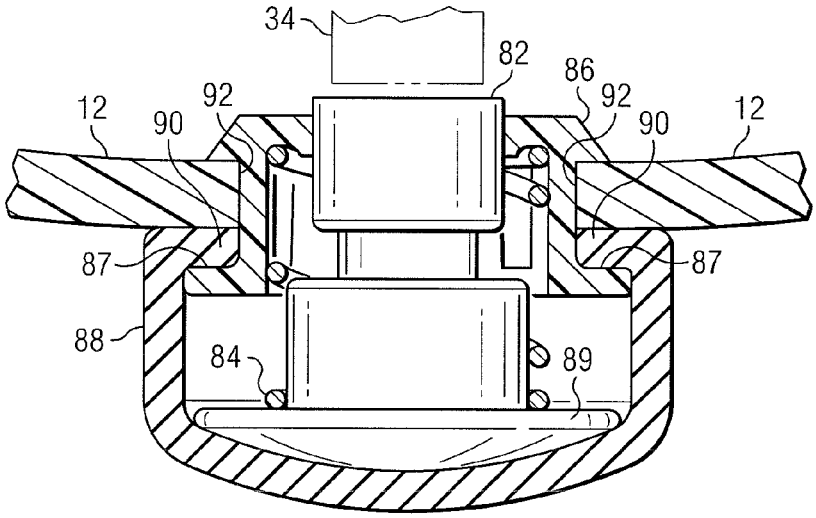
Figure 10:
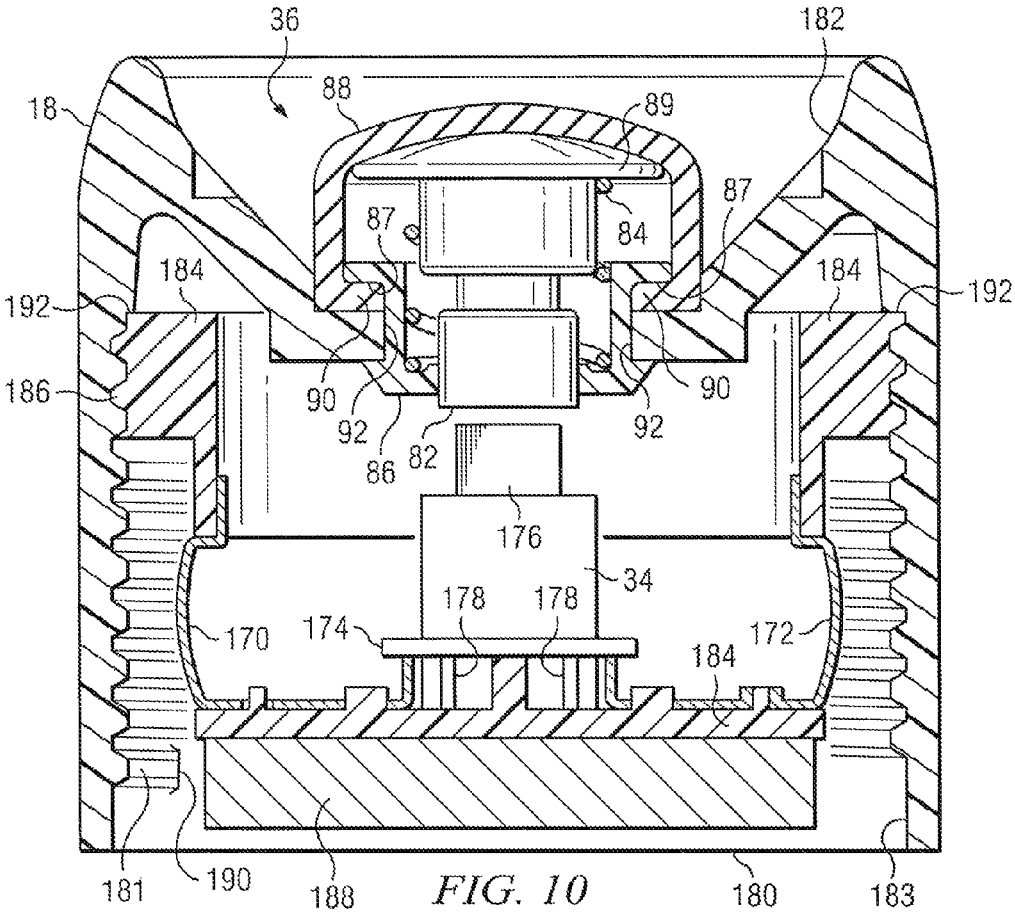

The actuator assembly 36 shown in FIGS. 7 and 10 (and also FIG. 2) includes a plunger 82 surrounded by a coil spring 84 and a grommet 86. The plunger 82 is capped at a first end by a disc-shaped head 89, which may illustratively have in this embodiment a substantially flat profile and a convex shape opposite the cylindrical body of the plunger 82 as shown. In other embodiments the head 89 portion of the plunger 82 may be less thin and/or have a flat or concave shape opposite the cylindrical body of the plunger 82 as shown. The surface underside of the wider diameter of the grommet 86 is designated with the reference number 87. The underside surface 87 is one side of a junction of two parts sealed by a gasket placed between the two parts, as will be described. The actuator assembly 36 further includes a flexible, resilient boot 88 that serves the dual purpose of completely covering the portions of the actuator mechanism external to the housing 12 and providing a dust- and water-resistant seal of the opening 92 in the side of the housing 12. The seal provided by the boot 88 is sufficient to enable the instrument 10 to comply with recognized standards for electrically operated instruments in explosive and high humidity environments. The boot 88 includes an inward-extending lip 90. The lip 90 may be trapped between the underside surface 87 of the collar or grommet 86, which supports the actuator mechanism 36 in the housing 12, and the outer surface of the housing 12 around the perimeter of the opening 92. The collar or grommet 86 of the actuator mechanism or assembly 36 acts as a bushing for the actuator plunger 82.

In the illustrated embodiment, the inward end of the grommet 86 may be castellated to provide a ring of flexible, resilient prongs 98 (See FIG. 8) in the body of the grommet. The resilient prongs 98 enable the inward end of the grommet 86 to be inserted through the opening 92 in the housing 12 and retained in place by the ring of resilient prongs 98. Upon installation, the ring of prongs 98 may flex inward as the grommet is pressed inward within the opening 92, and then "spring" outward as the inner ends of the prongs 98 clear the perimeter of the opening 92. The plunger 82 is retained in a retracted (i.e., released or "OFF") position by the tension in concentric spring 84. Thus, to summarize the foregoing assembly, it may be characterized as a push-button switch actuator 36 comprising a spring-loaded plunger button (the combination of plunger 82 and spring 84) slidingly disposed within a grommet 86 having resilient prongs 98 (See FIG. 8) formed in one side thereof, the combination enclosed within a flexible cup-shaped boot 88 having an inward directed lip 90 formed in an open side thereof such that the resilient prongs 98 extend through the open side of the boot 88 for inserting in the first opening 92 of the wall of the housing 12, and the lip 90 forms a seal between the combination and the first opening 92.

In the above embodiment, the plunger 82 and grommet 86 may be molded of a polycarbonate thermoplastic material such as Lexan® 121, the spring formed from stainless steel spring wire, and the boot 88 molded of an elastomer such as thermoplastic Vulcanizate (TPV), a material marketed by Exxon/Mobil under the name VYRAM TPV 9101-55. This material has a Shore A durometer of 55, and is characterized by its sealing, flexibility, and fatigue resistance capabilities. In other applications, an actuator as described herein may be sized appropriately, with the tension of the spring and the durometer of the boot respectively adjusted to suit the dimensions and the particular application.

Figure 8:
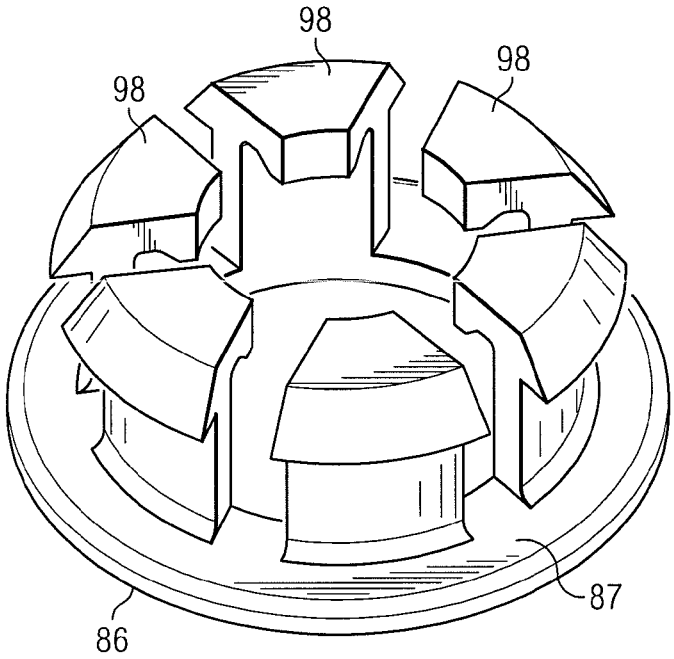

Referring to FIG. 8, there is illustrated a perspective view of the grommet 86 as used in the embodiment of the switch actuator assembly 36 shown in FIGS. 2, 7, 9, and 10. The cylindrical body of the grommet 86 is castellated to form a ring of prongs 98. In the present illustrative embodiment, six prongs, evenly disposed around the cylindrical form of the grommet, are used. The grommet 86 may be molded of a polycarbonate material such as Lexan® 121, and dimensioned to provide the requisite flexibility to flex inward during installation in the opening 80 of the housing. The prongs 98 are also designed to form the body of the grommet, providing a cylindrical body for the plunger 82 to move through during operation of the switch actuator 36. Upon installation, the prongs 98 flex inward as the switch actuator assembly is inserted into the opening 80 in the body of the housing 12 and pressed into the position shown in FIGS. 2, 7, and 10. When the switch actuator assembly is fully pressed into the opening 80, the resilience of the prongs restores them to their original shape and thereby retains the switch actuator assembly 36 in its fully installed position. It will be appreciated, referring to FIG. 7, that when the switch actuator assembly 36 is pressed into the opening 80 in the housing 12 and the prongs 98 restored to their relaxed position that the lip 90 of the resilient boot 88 is clamped—i.e., compressed—between the outer surface of the housing 12 and the underside of the wider diameter end of the grommet 86. This clamping action providses the seal that prevents the passage of dust or moisture therethrough.

Figure 9:
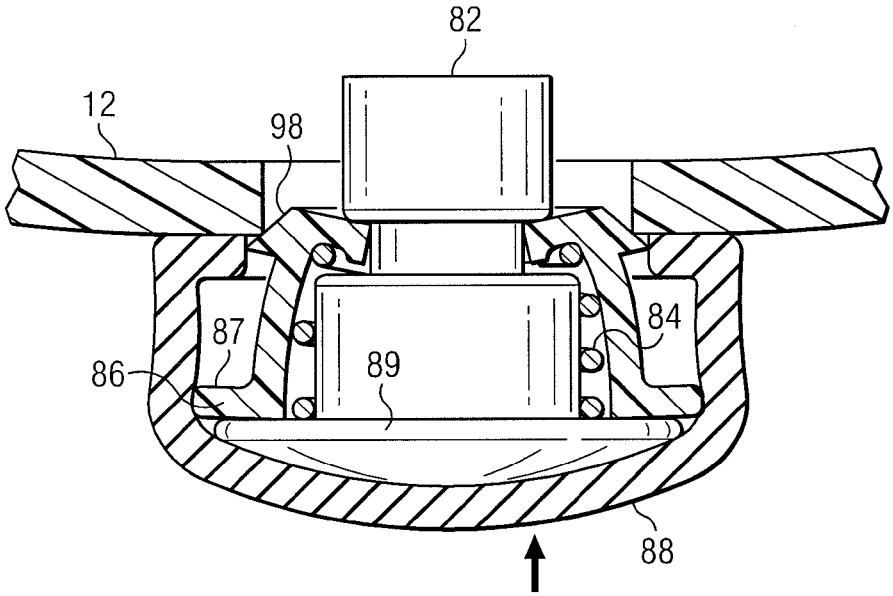

Referring to FIG. 9, installation of the actuator assembly 36 into the opening 92 of the housing 12 proceeds as follows. Before inserting the actuator assembly 36 in to housing opening 80, the resilient boot 88 is fitted over the plunger 82, spring 84, and grommet 86 assembly. As shown in FIGS. 2 and 7, the plunger 82 and its inward ends or prongs 98 of the grommet 86 are inserted into the opening 92 in the housing 12. Note that only a single prong 98 of the grommet 86 is shown for clarity. As shown in FIG. 9, inserting the inward end of the grommet 86 bends the free ends of the prongs 98 radially inward against the resilient tension of the prongs 98, causing them to flex inward then outward as the grommet 86 is pushed into and seated within the opening 92 in the housing 12. The prongs 98 expand to their normal or relaxed position under the restoring force inherent in the resilient prongs 98 to retain the actuator assembly within the opening 80. As the ring of prongs 98 expand back to their relaxed position, the inward-extending lip 90 of the boot 88 is captured and compressed by the inward end of the grommet 86 and the opening 92 in the housing 12. The actuator assembly 36 is thus retained in place and sealed against moisture and dust that may be present outside the housing 12 throughout the movement of the plunger 82 within the grommet 86 as the switch 34 is actuated. The seal not only provides resistance to the entry of dust and water, but also enables the product to comply with safety standards for explosion-proof designs.

As shown in FIGS. 7 through 10, the cylindrical body of the plunger 82 is surrounded by a concentric spring 84 to provide resistance to the push button plunger 82 as it is pressed inward of the housing 12 and to provide a restoring force as it is released. A preferred spring is formed of stainless steel formed into a helical coil having at least 1½ full turns. The concentric spring 84 may also be formed from a plastic or composite material having suitable properties. In use, the plunger 82 portion of the actuator slides smoothly within the body of the grommet 86 to contact an operative button of the switch 34 positioned within the housing 12 and proximate to the distal end of the actuator plunger 82. The plunger 82 is used to operate the switch button to close or open the contacts or to latch or unlatch the latching mechanism within the switch 34.

In another embodiment, illustrated in FIG. 10, an end cap 18 for a lighting instrument 10 of the type described herein includes a detachable cylindrical cap 18 open at a first end 180 and including a recessed region at a second end 182 thereof. The end cap 18 may be threadably secured to the first end 16 of the housing 12 of the instrument. A raised, internal screw thread 181 may be disposed within the cylindrical end cap 18 on an inner wall 183 thereof and extending helically toward the open first end. The internal thread 181 of the end cap 18 may extend to an abrupt, butt stop 190 disposed at a predetermined diameter of the end cap 18 near the open first end 180, such that the butt stop 190 is brought into contact with a corresponding stop 212 (see FIG. 11) formed proximate a mating externally threaded portion of the housing 12 of the instrument when the end cap 18 is installed on the housing 12. The purpose of the stop feature 190 is to ensure that components within the end cap 18 are correctly aligned with corresponding components in the housing 12 when the end cap 18 is fully threaded onto the housing 12. For example, contacts from a switch 34 in the end cap 18 may be brought into full contact with contacts in the housing 12 to complete an electrical circuit between them.

The end cap may further house a sealed switch actuator 36 as described above (See, e.g., FIGS. 2 and 7) or a switch actuator 36 and switch assembly 34 supported in the second closed end 182 of the end cap 18, wherein the actuator assembly 36 for the switch assembly 34 may include the same mechanism components (82, 84, 86, 87, 88) sealed against moisture and dust as described for FIG. 7. The switch actuator assembly 36 may be installed within a recessed region of the second closed end 182 of the end cap 18 as shown in FIG. 10. The recessed region includes an opening 92 into which the actuator assembly 36 may be inserted as described herein above. The same reference numbers used for FIGS. 2 and 7 are used in FIG. 10 to indicate the same structural features of the switch actuator 36 and the opening in the housing into which it is installed. An end cap 18 so configured may further include a switch holder 184, which houses the switch 34 and first and second contacts, respectively 170, 172 for connecting the switch 34 to circuits within the housing 12 of the instrument 10.

Continuing with FIG. 10, the switch holder 184, which appears in cross section in the figure, is configured as a cup-shaped chamber for supporting the switch 34 in the bottom of the cup and providing for connecting the actual contacts 178 of the switch 34 to a sub-board 174, which in turn provides connections of the actual contacts 178 to the first and second contacts 170, 172 through soldered connections on the sub-board 174. The switch holder 184 thus forms an assembly that may be threaded into the end cap 18 by the threads 186 formed into the outside of the upper portion of the switch holder 184. In use, the switch holder 184 is screwed into the end cap 18 until it is stopped by a shoulder 192 within the end cap 18. Upon assembly of the switch holder 184 within the end cap 18, a resilient pad 188 is attached to the underside of the switch holder 184, preferably using an adhesive such as double sided tape or an equivalent adhesive. The resilient pad 188 provides a cushion for absorbing shock transmitted from the housing 12 to the internal components in the event the instrument 10 is dropped. In the present embodiment, for example, the battery power supply, which may be housed within the housing 12 at the second end 16 and has substantial mass, is allowed to move slightly within the housing 12 while its motion is absorbed by the resilient pad 188. Switch holder 184 may be molded of a thermoplastic polycarbonate material such as Lexan 121 previously identified for the unitary body 12, end cap 18, lens 20, and plunger 82 and grommet 86.

Several alternative features may be incorporated into the design of the instrument 10. For example, an O-ring gasket (not shown) may be disposed around the housing between a shoulder surrounding the housing proximate the threaded portion and the first open end 180 of the end cap 18. The structure of the end cap 18 allows the switch actuator assembly 36 to be completely recessed within a recessed region disposed in the end of the end cap 18. This features enables the instrument 10 to be stood on its end in the manner of a table light.

Figure 11:
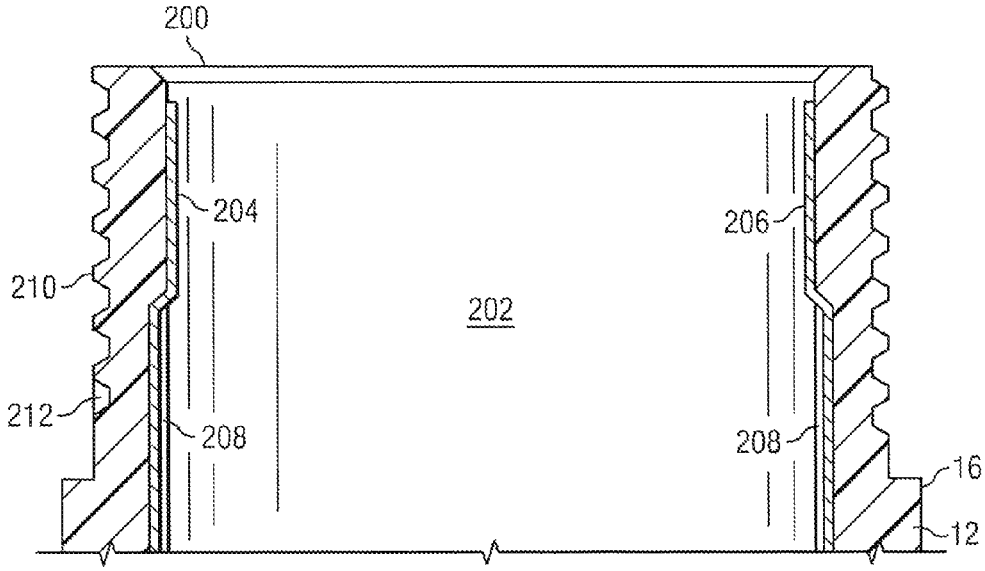
FIG. 11 illustrates details of a first end of the housing of the embodiment of FIG. 1 configured for use with the end cap described and illustrated in FIG. 10.

FIG. 11 illustrates details of a second end 16 of the unitary body or housing 12 configured for use with the end cap 18 described and illustrated in FIG. 10. A portion of the second end 16 of the housing 12 includes a rim 200 of the cylindrical housing 12 that provides a hollow cylindrical space 202 for a battery pack (not shown). Contact with the terminals (not shown) of the battery pack inside the housing 12 are provided through first and second power circuit contacts, respectively 204, 206, which are insulated from the battery pack by a sleeve 208. External threads 210 formed into the outside of the second end 16 of the housing 12 enable the internal threads 182 of the end cap 18 to be threaded onto the threads 210 of the housing 12 until the butt stop 190 contacts the corresponding stop 212. When fully threaded onto the housing 12, the first and second switch contacts 170, 172 in the switch holder 184 are brought into contact with the corresponding first and second power circuit contacts 204, 206.

To extend the concept of self-aligning structures described herein above during final assembly that facilitates reliability by ensuring stability of the alignment of interconnecting parts, other features of the present invention may be provided. For example, the lighting instrument illustrated in FIG. 1 depicts a housing 12 that includes a cylindrical portion (see the tail or distal end 16) useful as a handle and for containing one or more rechargeable battery cells. It is self evident that at least one conductor must be included to connect a battery terminal at the distal (tail) end 16 of the housing 12 to circuitry enclosed within the forward end 14 of the housing 12. In one embodiment, the battery terminal near the end 16 may be connected to an insulated conductive sleeve surrounding the battery cell(s) and provided with a terminal proximate the opposite end of the cell(s) within the housing 12 for connection to the circuitry within the portion 14 of the housing 12. In an alternate embodiment, thin strip-like conductors may be routed between a wall of the housing 12 and a thin, insulating sleeve (not shown) from one end, e.g., 16, toward the opposite end, e.g., 14. The same concept may be use to insulate conductive strips connecting a switch, for example, enclosed in the end cap 18 to contacts of a terminal board within an intermediate portion of the housing 12 (as, for example, illustrated in FIG. 12 at 250, or in FIG. 2 at a terminal board such as PC board 94. These features may be illustratively visualized in a cutaway drawing similar to FIG. 1, showing a cutaway portion of the tail end 16 depicting the battery pack and conductors and insulating sleeves.

Figure 12:
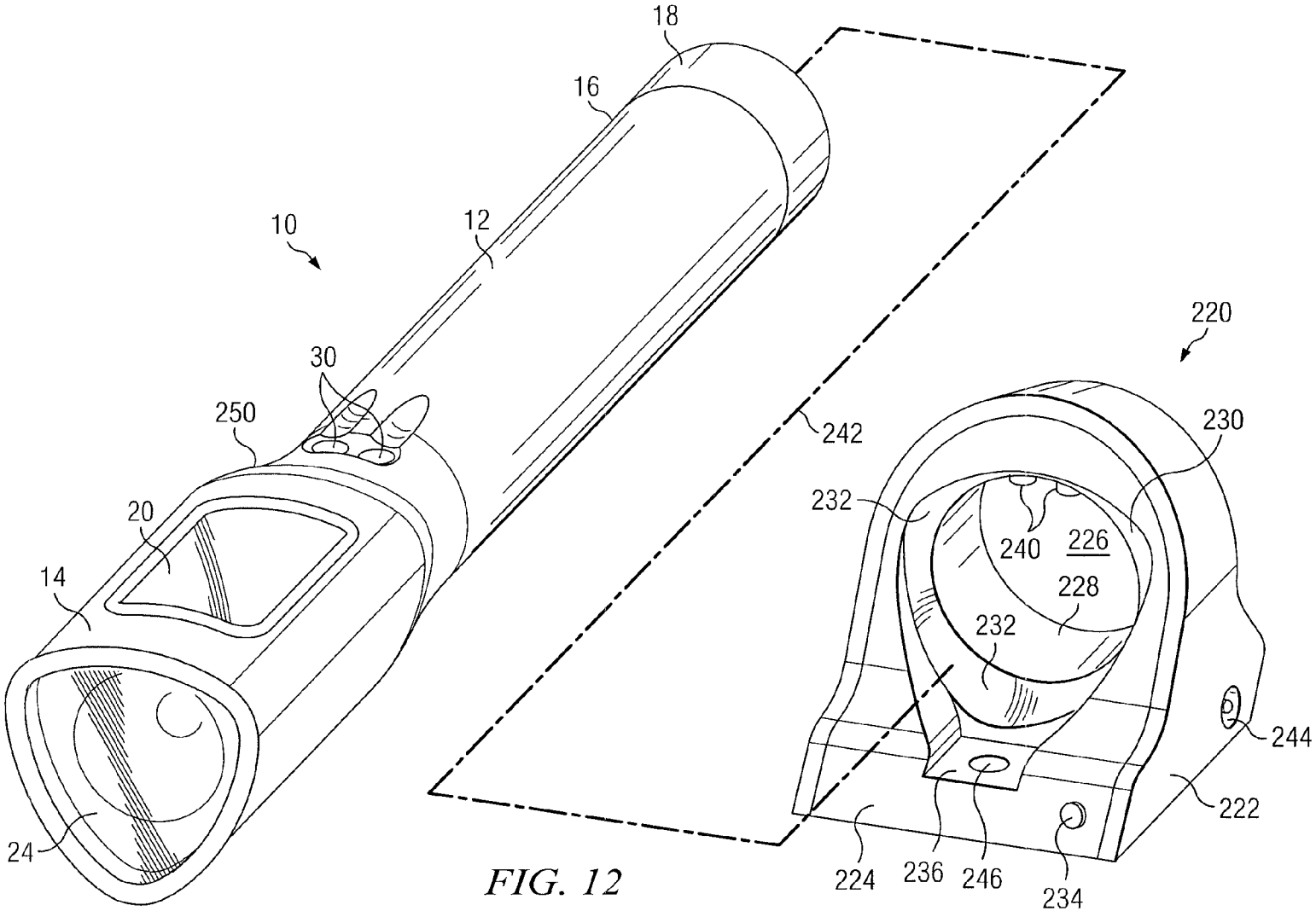
FIG. 12 illustrates a battery charging station configured as a docking station for the embodiment of FIG. 1.

FIG. 12 illustrates a docking station 220 configured as a battery charger for the hand-held lighting instrument 10 of the present invention. The docking station 220 enables charging of the rechargeable batteries contained within the housing 12 of the instrument 10 without having to remove the battery cells. The handheld lighting instrument 10 of FIG. 1 is shown in FIG. 12 to illustrate the instrument 10 in a position ready for docking with the docking station 220 as indicated by the broken line 242. The instrument 10 bears the same reference numbers indicating several of its structural features as illustrated in FIG. 1. The view shown in FIG. 12 also identifies a mid-body transition region 250 of the housing 12 wherein the trilobal cross section form of the forward portion 14 of the housing 12 merges with the circular cross section form of the rearward portion 16 of the housing 12.

The docking station 220 in FIG. 12 includes a housing 222 for enclosing the charging circuitry. The housing 222 of the docking station 220 includes a front face 224. A passage 226 extending completely through the housing 222 is provided to receive the round portion 16 of the body 12 of the lighting instrument 10 when it is inserted into the passage 226 for charging the battery pack contained within the lighting instrument 10. The passage 226 has an inside wall 228 and an entry port 230 formed in the front face 224 of the housing 222 of the docking station 220. The entry port 230 also includes a relieved transition 232 at the entry port 230 formed as the complement of the three-sided (or trilobal) housing shape of the lighting instrument 10 at the transition region 250 thereof. The relieved transition 232 functions to receive the trilobal shape of the transition region 250 therein, thus providing a keying or self-aligning feature for the instrument 10 as it is inserted within the passage 226 of the docking station 220.

Continuing with FIG. 12, as the instrument 10 with its contacts 30, 30 oriented upward, is inserted into the docking station passage 226 for charging along the path indicated by the broken line 242, the three-sided configuration of the relieved transition 232 causes the instrument's housing 12 to rotate slightly as necessary to ensure alignment of the instrument's charging contacts 30, 30 with the charger's output contacts 240, 240 within the forward, portion of the docking station 220. It will be appreciated that the trilobal form of the forward portion 14 of the housing 12 of the instrument 10 is exploited to advantage in enabling the docking of the instrument 10 into a charging position with the docking station 220. This self-keying features enables the contacts 30, 30 of the lighting instrument 10 to automatically align with the charging contacts 240, 240 of the docking station 220 when the instrument 10 is fully inserted into the entry port 230.

A pilot indicator 234 may be located near the entry port 230 of the docking station 220 to indicate the status of the charging operation—whether it is turned ON or OFF or is not connected to a power source, or charging, or fully charged, for example. The indicator 234 may be a light emitting diode, for example. The charging circuit, if it relies on an external DC power source (not shown) for example, may include a connector 244 to permit coupling between the battery charger in the docking station 220 and the DC power source. The DC power source may illustratively be a small AC to DC converter, power pack, or the DC electrical system of a vehicle. In an alternate embodiment, the entry port 230 may include a recess 236 in one position around the perimeter of the entry port 230 to act as an orientation key way to ensure the correct surface that contains the charging contacts of the instrument 10 is positioned in the entry port 230. The recess 236 may further provide clearance for other external features of the housing 12 such as the push button switch actuator 36 shown in FIG. 2. Other features of the docking station 220 may include a mounting hole 246 for attaching it to a surface, preferably a wall or other substantially vertical surface to take advantage of gravity to retain the instrument in position while charging.

There may be two basic versions of the flashlight instrument of the present invention: one is an industrial standard instrument for commercial use; the other, a safety-enhanced unit, is specially designed for use in explosive or hazardous environments. Some of the features necessary for compliance with the requirements for hazardous environments may be included in a standard, commercial product. Such features may include the sealing mechanisms employed in the product, including the gaskets 70, 74 respectively disposed between the lenses 20, 24 and the openings 80, 72 in the housing, the gasket 212 between the end cap 18 and the housing 12, and the sealed switch actuator assembly 36. The safety-enhanced unit may include the above-mentioned sealing mechanisms against dust and moisture, a housing formed of non-metallic material that is resistant to most hazardous environments and is unable to cause sparks, and circuitry that contains fault protection features to minimize the likelihood of arcing or acting as a source of ignition in an explosive atmosphere.

While the invention has been shown in only one of its forms, it is not thus limited but is susceptible to various changes and modifications without departing from the spirit thereof.

What is claimed is:

1. A sealed push button actuator assembly for installation in an opening in the wall of a housing of an appliance, comprising:

an actuator assembly supported in said opening of said housing, said assembly including a grommet having disposed there within a push button plunger having a concentric spring there around and configured for sliding movement against tension in said spring within said grommet;

said push button plunger further comprising a cylindrical body capped at a first end by a transverse disc-shaped head having a substantially flat profile and a reduced diameter portion of said body at a second end thereof opposite said first end and forming a shoulder; and a resilient boot enclosing portions of said actuator assembly external to said housing, said boot having a circumferential, inward-extending lip clamped between said grommet and the periphery of said opening in said housing, to provide a dust and moisture resistant seal of said opening.

2. The apparatus of claim 1, wherein said grommet is slotted around a lower portion of the length of said grommet in at least three equally-spaced circumferential locations thereof, thereby defining equally-spaced prongs there around.

3. The actuator assembly of claim 1, wherein said push button plunger further comprises:

a circumferential groove adjacent said shoulder to enable said prongs of said grommet to flex inward during assembly into said opening in said housing.

4. The actuator assembly of claim 2, wherein said prongs of said grommet further comprise:

outward and inward extending teeth disposed at the distal end of each said prong, such that said outward extending teeth retain said push button within said opening of said housing when said push button is in a released position, and said inward extending teeth support a second end of said concentric spring upon assembly of said push button, grommet and spring.

5. The apparatus of claim 1, wherein said concentric spring comprises:

a helical spring having at least 1.5 active coils for withstanding at least 20 oz, at full compression.

6. The actuator assembly of claim 1, wherein said resilient boot comprises:

a cup-shaped flexible boot formed of a thin, elastic material selected from the group consisting of neoprene, rubber, and thermoplastic elastomer.

7. A sealed push button actuator assembly for use with an appliance, comprising:

a push button plunger having a cylindrical body, a disc-shaped head disposed at a first end thereof and having a coil spring disposed around said body and against an underside of said disc-shaped head of said plunger;

a grommet having a hollow, cylindrical body having an enlarged rim at a first end of said body and a circular array of prongs at a second end thereof, said second end further including inward-extending fingers for retaining said spring;

wherein said plunger with said coil spring is assembled within said grommet and configured for longitudinal movement within said hollow body of said grommet against tension of said spring; and a resilient, cup-shaped boot open at a first side and surrounding said assembly, said open first side of said boot having a circumferential, inward-extending rim for being clamped between said enlarged rim of said grommet and a periphery of said opening in said wall when installed therein.

8. The apparatus of claim 7, said push button plunger comprising:

a cylindrical body capped at a first end by a transverse disc-shaped head having a substantially flat profile; and a reduced diameter portion of said body at a second end thereof opposite said first end and forming a shoulder.

9. The apparatus of claim 8, wherein said grommet is slotted around a lower portion of the length of said grommet in at least three equally-spaced circumferential locations thereof, thereby defining equally-spaced prongs there around.

10. The apparatus of claim 7, wherein said grommet body is hollow and castellated along a lower portion of its length in at least three equally-spaced circumferential locations thereof, thereby defining an array of equally-spaced prongs there around.

11. The actuator assembly of claim 10, wherein said prongs of said grommet further comprise:

outward and inward extending teeth disposed at the distal end of each said prong, such that said outward extending teeth retain said push button within said opening of said housing when said push button is in a released position, and said inward extending teeth support a second end of said coil spring upon assembly of said push button plunger, grommet, and spring.

12. The apparatus of claim 7, wherein said coil spring comprises:

a helical spring having at least 1.5 active coils for withstanding at least 24 oz, at full compression.

13. The actuator assembly of claim 7, wherein said resilient boot comprises:

a cup-shaped flexible boot formed of a thin, elastic material selected from the group consisting of neoprene, rubber, and thermoplastic elastomer.

* * * * *